US005550010A

United States Patent [19]

Bredoux et al.

[11] Patent Number: 5,550,010

[45] Date of Patent: Aug. 27, 1996

[54] METHOD FOR PROCESSING PHOTOGRAPHIC PRODUCTS COMPRISING A FINE-GRAIN TOP LAYER

[75] Inventors: François J. Bredoux, Saint Martin en Bresse; Yannick Begel, Chalon-Sur-Saone; Henri Freisz, Les Lilas, all of France

[73] Assignee: Eastman Kodak Company, Rochester, N.Y.

[21] Appl. No.: 295,848

[22] PCT Filed: Mar. 9, 1993

[86] PCT No.: PCT/EP93/00535

§ 371 Date: Aug. 31, 1994

§ 102(e) Date: Aug. 31, 1994

[87] PCT Pub. No.: WO93/19397

PCT Pub. Date: Sep. 30, 1993

[30] Foreign Application Priority Data

Mar. 16, 1992 [FR] France ..... 92 03330

[51] Int. Cl.[6] ..... G03C 7/42

[52] U.S. Cl. ..... 430/393; 430/379; 430/407; 430/430; 430/460; 430/461

[58] Field of Search ..... 430/379, 393, 430/407, 430, 460, 461

[56] References Cited

U.S. PATENT DOCUMENTS

| | | | |
|---|---|---|---|
| 1,905,188 | 4/1933 | Sease | 430/507 |
| 3,728,121 | 8/1970 | Zorn et al. | 430/509 |
| 3,790,384 | 2/1974 | Oishi et al. | 430/508 |
| 4,229,525 | 10/1980 | Ueda | 430/568 |
| 4,369,248 | 1/1983 | Ranz et al. | 430/376 |
| 4,456,681 | 6/1984 | Kadowaki et al. | 430/505 |
| 4,542,091 | 9/1985 | Sasaki et al. | 430/380 |
| 4,596,764 | 6/1986 | Ishimaru | 430/393 |
| 4,614,707 | 9/1986 | Fujita et al. | 430/379 |
| 4,640,890 | 2/1987 | Fujita et al. | 430/504 |
| 4,812,390 | 3/1989 | Giannesi | 430/434 |
| 4,873,181 | 10/1989 | Miyasaka et al. | 430/523 |
| 5,009,988 | 4/1991 | Yagi et al. | 430/505 |
| 5,360,709 | 11/1994 | Ohkawa et al. | 430/544 |

FOREIGN PATENT DOCUMENTS

| | | |
|---|---|---|
| 3614751 | 10/1986 | Germany . |
| 124424 | 10/1978 | Japan . |
| 7112751 | 7/1982 | Japan . |
| 9068731 | 4/1984 | Japan . |
| 0128441 | 7/1985 | Japan . |
| 61-39043 | 2/1986 | Japan . |
| 1077849 | 4/1986 | Japan . |
| 63-046438 | 2/1988 | Japan . |
| 63/124044 | 5/1988 | Japan . |
| 63/301946 | 12/1988 | Japan . |
| 3194550 | 8/1991 | Japan . |
| 500611 | 2/1939 | United Kingdom . |
| 555508 | 8/1943 | United Kingdom . |
| 680631 | 10/1952 | United Kingdom . |
| 2164167 | 3/1986 | United Kingdom . |

*Primary Examiner*—Hoa Van Le
*Attorney, Agent, or Firm*—J. Lanny Tucker

[57] ABSTRACT

The present invention relates to a color photographic processing method, and a product for color photography comprising, in addition to the conventional layers of light-sensitive silver halides, a non light-sensitive top layer.

The method and photographic product enable sensitivity to be controlled during photographic processing.

The invention also makes it possible to prevent deterioration of the processing baths.

14 Claims, 10 Drawing Sheets

TOP LAYER 100% CI

TOP LAYER 100 % Br

METHOD FOR PROCESSING PHOTOGRAPHIC PRODUCTS COMPRISING A FINE-GRAIN TOP LAYER

The present invention relates to a color photographic processing method, and a product for color photography comprising, in addition to the conventional light-sensitive silver halide layers, a top layer which is insensitive to light.

U.S. Pat. No. 4,596,764 describes a photographic processing method which consists of bringing into contact, during the photographic processing, a product comprising light-sensitive silver halide emulsion layers with a high iodide content and an emulsion layer which is not sensitive to light with an amino compound (I) of the formula:

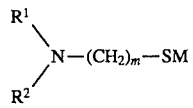

wherein M represents a hydrogen atom, an alkali metal, an alkaline earth metal, a quaternary ammonium group, a quaternary phosphonium group, an amidino group or a group of the formula

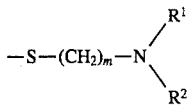

wherein $R^1$ and $R^2$ each represent separately a hydrogen atom or an aliphatic group, and m represents an integer between 2 and 4; or with a strong acid salt.

The protective layer described in this patent comprises a fine-grain emulsion with an iodide content of less than 3% molar, the quantity laid down to form this top layer being between 50 and 140% molar of the total quantity of silver iodide in the light-sensitive layers. It is clear in the art that when a photographic product contains a large quantity of silver iodide, the fixing has a reduced efficiency related to the low solubility of the silver iodide. The method described in the patent cited above proposes to avoid the problem encountered during the fixing stage by processing the color photographic product described above in the presence of a compound (I).

The examples in U.S. Pat. No. 4,596,764 show that, in the presence of a compound (I), the best sensitometric results are obtained when the protective layer consists of a pure bromide emulsion or a pure chloride emulsion with very fine halide grains, of the order of 0.07 μm, with however a slight increase in fogging. In all the examples, the photographic products contain at least 5% molar of silver iodide in each light-sensitive layer. After exposure, these products are brought into contact with a compound of formula (I) by means of a separate bath used before the bleaching and fixing baths.

U.S. Pat. No. 4,640,890 describes a color photographic product comprising a base, at least one red-sensitive layer, one green-sensitive layer and one blue-sensitive layer, with, in at least one of these sensitive layers, a monodisperse emulsion. The photographic product comprises moreover an additional layer consisting of a non light-sensitive silver halide emulsion with a chloride content greater than 75% molar. This additional layer makes it possible to decrease the variations in the sensitometric characteristics during the processing. In fact, it has been found that the sensitometric characteristics vary greatly according to the agitation of the developer.

The examples in U.S. Pat. No. 4,640,890 show the differences in sensitivity and contrast of the product of the invention processed in an agitated developer and in a non-agitated developer. It can be noted that the higher the chloride content, the smaller are the variations in the sensitometric characteristics. These results are even more improved when the additional layer contains a rhodium salt.

The present invention makes it possible to remedy the problem of variations in sensitivity due to contamination of the baths during automatic processing of the photographic products. In fact, in some automatic processing machines, the photographic products pass from one bath to another by means of a conveyor belt made from plastic material such as polypropylene or nylon. These plastic materials at the same time convey small quantities of chemical compounds contained in the photographic baths. These compounds conveyed on the belt contaminate the different photographic baths during the remainder of the processing. For example, it has been observed that certain bleaching accelerator compounds, initially present in the bleaching or bleach-fixing baths, are partly conveyed on the conveyor belt and are then reintroduced into the developer. The presence of this type of compound in the developer has a bad effect on the sensitometric properties of the photographic products thus processed.

FIGS. 1, 2, 3, 4 and 5 show the variations in the sensitometric characteristics of the photographic products described in the following examples versus the quantity of contaminant in the developer.

The object of the present invention is a method for controlling, during photographic processing, the sensitivity of a color photographic product by preventing an excessively rapid deterioration of the first developer. The method consists of processing an exposed color product comprising a base, at least one light-sensitive silver halide emulsion layer and a top layer of non light-sensitive silver halide emulsion by means of a process comprising at least one developing stage and one bleaching or bleach-fixing stage, the method being characterised in that (A) the top layer of the photographic product consists of an emulsion comprising silver halide grains having a size of less than 0.5 μm and a bromide content of between 30 and 70% molar, and (B) the processing is carried out in the presence of a compound (1) which corresponds to the formula:

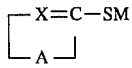

or its tautomeric form, wherein X represents a carbon atom or a heteroatom such as sulphur, oxygen or nitrogen, A represents the complementary atoms required to form an unsaturated ring which may contain one or more heteroatoms and M represents a hydrogen atom, an alkali metal, an alkaline earth metal or an ammonium group.

For example, M may be chosen from amongst lithium, potassium, sodium, calcium or magnesium or the groups $(CH_3)_4N^+$, $(C_2H_5)_4N^+$, etc.

According to the invention, compound (1) is a bleaching accelerator compound chosen from amongst the azole, diazole, triazole or tetrazole derivatives substituted with a thiol radical. These compounds are particularly active through the presence of the —N=C—$S^-$ grouping or its tautomeric form. The preferred bleaching accelerator compounds of the invention are, for example, 1,2,4 triazol-3-thiol, 1,2,3-triazol-4-thiol, 1,2,3,4-tetrazol-5-thiol and glyoxaline-2-thiol.

Another object of the present invention is a photographic product comprising, in addition to the image-forming emulsion layers, a non light-sensitive top layer consisting of an emulsion comprising silver halide grains with a size of less than 0.5 μm and a bromide content of between 30 and 70% molar.

The top layer of the photographic product according to the invention consists of a fine-grain emulsion; this emulsion is preferably monodisperse.

In the present description, monodisperse emulsions means emulsions, the coefficient of variation (COV) of whose grain sizes is less than 35%, the coefficient of variation being defined by the formula:

$$COV=\sigma\cdot 100/D$$

in which σ is the standard deviation and D the mean size of the grains, represented by the mean diameter when the grains are spherical or by the mean value of the diameters of circular images having the same surface area as the projected images of the grains, when they are not spherical.

The mean equivalent diameter of the grains which make up the emulsion of the top layer is preferably between 0.1 and 0.3 μm. The emulsion of the top layer according to the invention is a bromochloride emulsion with a bromide content preferably between 45 and 55% molar. The coverage of the top layer is between 0.05 and 0.5 mg/dm$^2$.

The color photographic products which are used in the present invention generally comprise a base bearing at least one blue-sensitive silver halide emulsion layer with which a yellow dye forming coupler is associated, at least one green-sensitive silver halide emulsion layer with which a magenta dye forming coupler is associated, and at least one red-sensitive silver halide emulsion layer with which a cyan dye forming coupler is associated, and the top layer of the invention.

These products can contain other conventional layers in the photographic products such as spacing layers, filtering layers, anti-halo layers and immobilising layers. The base can be any suitable base used with photographic products. Conventional bases comprise polymer films, paper (including polymer-coated paper), glass and metal. *Research Disclosure*, December 1978, No 17643, Section XVII, provides details about bases and additional layers for photographic products.

The preparation of silver halide emulsions is described , for example, in *Research Disclosure*, No 17643, Sections I and II. Silver halide emulsions can be chemically sensitised in accordance with the methods described in Section III of the *Research Disclosure* referred to above. The chemical sensitisers generally used are compounds of sulphur and/or selenium and gold. It is also possible to use sensitisation by reduction. The halide grains can have different compositions. For example, it is possible to use grains of silver bromide, silver iodobromide, silver chloride, silver chloroiodide or silver chlorobromoiodide. The silver halide grains can be spherical, cubic, octahedral, cubo-octahedral or tabular. The silver halide grains can be of the core/shell type, for example as in U.S. Pat. No. 3,505,068, or can include epitaxial deposits as in U.S. Pat. No. 4,713,320. These silver halide emulsions can in addition contain doping agents, generally in small quantities, such as rhodium, indium, osmium, etc ions.

The silver halide emulsions and other layers on the photographic products of this invention can contain, as a vehicle, hydrophilic colloids, used alone or in combination with other polymeric substances (for example latexes). Suitable hydrophilic substances comprise natural substances such as proteins, protein derivatives, cellulose derivatives, for example cellulose esters, gelatin, for example gelatin treated with a base (cattle gelatin, bone or tanned) or gelatin treated with an acid (pigskin gelatin), gelatin derivatives, for example acetylated gelatin, phthalated gelatin, etc, polysaccharides such as dextran, gum arabic, zein, casein, pectin, collagen derivatives, collodion, agar-agar and albumin.

The emulsions can be polydisperse or monodisperse or can consist of a mixture of emulsions with different grain sizes and/or dispersities.

The spectral sensitisation, or chromatisation, methods are described in the same publication, Section IV. The sensitising dye can be added at various stages of preparation of the emulsion, in particular before, during or after the chemical sensitisation.

The silver halide emulsions can be sensitised spectrally with dyes from various classes, including the class of polymethine dyes, which comprises cyanines, merocyanines, complex cyanines and merocyanines (that is to say tri-, tetra-, and polynuclear cyanines and merocyanines), oxonols, hemioxonols, styryls, merostyryls and streptocyanines. *Research Disclosure*, No 17643, mentioned above, Section IV, describes the representative spectral sensitising dyes.

The photographic products of the invention can contain, amongst other things, optical brighteners, antifogging agents, surfactants, plasticisers, lubricating agents, tanning agents, stabilisers and absorption and/or diffusion agents as described in Sections V, VI, VIII, XI, XII and XVI of the *Research Disclosure* referred to above.

The methods of adding these different compounds and the coating and drying methods are described in Sections XIV and XV.

According to the invention, the color photographic products comprise, in a conventional manner, at least three constituents which are respectively blue, green and red-sensitive and supply respectively the yellow, magenta and cyan components of the color image subtractive synthesis.

According to one embodiment, the photographic products of the invention are reversible products and the processing method of the invention is a reversal method.

The reversible products of the invention preferably comprise at least one layer comprising a polydisperse sensitive emulsion. This polydisperse emulsion is preferably highly sensitised and associated with one or more slower monodisperse emulsions with a COV of less than 35%. The other layers of the photographic product comprise one or more monodisperse emulsions with a COV of less than 35% and whose mean size varies according to the speed desired. These monodisperse emulsions can be prepared by double-jet precipitation in the presence of a solvent of silver halides such as a thioether, thiourea or thiocyanate. It is also possible to use core/shell monodisperse emulsions, in which the core and shell have variable halide contents, for example emulsions whose core is formed by silver bromoiodide and whose shell contains a quantity of iodide less than that of the core, which can be equal to zero. Such emulsions have been described, for example, in U.S. Pat. Nos. 3,206,313 and 3,505,068 and in French Patent 1 367 941.

In a preferred embodiment, the monodisperse emulsions are emulsions with an octahedral core/shell structure of silver bromoiodide containing in total less than 10% molar of iodide, and preferably 3 to 5% molar of iodide, doped with iridium. These monodisperse emulsions are chemically sensitised in a conventional manner, as indicated in *Research Disclosure*, December 1989, No 308119, Section IIIA, and spectrally as indicated in the same reference, Section IV.

Each chromatised constituent of the product can comprise at least two emulsions, and preferably three emulsions, with different speeds, that is to say a fast emulsion and a slow emulsion, or else a fast one, a medium one and a slow one. These emulsions are mixed in a single layer or introduced in separate layers.

The reversible products, after being exposed, undergo photographic processing comprising a silver development of the latent image (black and white development), then a reversal, which consists of making the non-exposed residual silver halide grains developable by a fogging exposure or chemical fogging, and subjecting these fogged silver halide grains to a color development, in the presence of a color developer and a coupler, the latter generally being incorporated in the reversible product.

The photographic products are then washed and put through a bleaching bath and then a fixing bath, before being processed in a stabilising bath.

The silver development takes place in the presence of a reducing compound which makes it possible to transform the exposed silver halide grains into metallic silver grains. These compounds are chosen from amongst the dihydroxybenzenes such as hydroquinone, the 3-pyrazolidones, the aminophenols, etc. These compounds can be used alone or in a mixture. This first bath can, moreover, contain a stabiliser such as sulphites, and a buffer such as carbonates, boric acid, borates or alcanolamines.

The reversal stage is usually carried out chemically, either by passing through a fogging bath containing a reducer, or by introducing the fogging agent into the color bath. The fogging substances are, for example, stannous chloride, hydrazine and semi-carbazide salts, ethylene diamine, sodium borohydride, dimethyl borane or thiourea dioxide.

The color developer contained in the color developing bath, which makes it possible to obtain the color image, is in general an aromatic primary amine such as the p-phenylenediamines, especially the N,N-dialkyl-p-phenylenediamines or an alkyl radical, and the aromatic ring can be substituted or not. The p-phenylenediamines used as color developers are, for example, N,N-diethyl-p-phenylenediamine monochlorhydrate, 4-N,N-dimethyl-2-methylphenylenediamine monochlorhydrate, 4-(N-ethyl-N-2-hydroxyethyl)-2-methylphenylenediamine sulphate. This color developing bath can contain other compounds such as stabilisers or development accelerators which are generally pyridinium compounds or other compounds.

The essential compound in the bleaching bath is an oxidising compound which converts the metallic silver into silver ions such as, for example, the alkali metal salts of a ferric complex of an aminocarboxylic acid, or persulphate compounds.

The bleaching compounds normally used are the ferric complexes of nitrolotriacetic acid, ethylenediamine tetracetic acid, 1,3-propylenediamine tetracetic acid, triethylenetriamine pentacetic acid, ortho-diamino cyclohexane tetracetic acid, ethyliminodiacetic acid, etc.

The fixing bath makes it possible to convert the silver halide completely into a soluble silver complex which is then eliminated from the layers on the photographic product. The compounds used for fixing are, for example, thiosulphates, such as ammonium thiosulphates, or alkali metals. Stabilising agents and sequestering agents can be added to the fixing bath.

The bleaching bath and fixing bath can be replaced with a single bleach-fixing bath. The bleaching accelerating compound is generally either in the bleaching bath or in the bleach-fixing bath. The processing generally comprises a stabilising bath containing a color stabiliser such as formaldehyde, and a wetting agent.

In the following examples, the color reversible photographic products are exposed and processed in accordance with the standard Ektachrome™ R-3 process.

EXAMPLE 1

The photographic products used in the examples of the invention comprise emulsion layers according to the following structure, applied to a paper base covered with polyethylene:

| | |
|---|---|
| Anti-UV layer | |
| Blue-sensitive emulsion layer comprising a yellow coupler | |
| Fast | Polydisperse emulsion |
| Slow | Core/shell monodisperse emulsion (0.7 μm) |
| Filter layer comprising yellow colloidal silver | |
| Green-sensitive emulsion layer comprising a magenta coupler | |
| Fast | Polydisperse emulsion |
| Medium | Core/shell monodisperse emulsion (0.7 μm) |
| Slow | Core/shell monodisperse emulsion (0.43 μm) |
| Layer containing grey colloidal silver | |
| Red-sensitive emulsion layer comprising a cyan coupler | |
| Fast | Core/shell monodisperse emulsion (1.07 μm) |
| Medium | Core/shell monodisperse emulsion (0.43 μm) |
| Slow | Core/shell monodisperse emulsion (0.38 μm) |
| Gelatin + Non-sensitive fine-grain emulsion | |
| BASE | |

The polydisperse emulsion is an emulsion containing octahedral silver bromoiodide grains with an iodide content of less than 5% and a mean equivalent diameter of the order of 1 μm, preferably highly sensitised. This emulsion can be prepared and sensitised in accordance with the method described in European patent application 91912604.5.

The monodisperse core/shell emulsions (COV≦35%) comprise octahedral grains containing a total iodide content of less than 5%, the iodide being located mainly in the core.

The emulsion of the layer in contact with the base is an emulsion containing non light-sensitive silver halide grains (of the order of 0.11 μm) prepared in accordance with the method described in Chimie et Physique Photographique, by P Glafkides, 4th Edition, page 481.

EXAMPLE 2

Preparation of the emulsions in the top layer

The fine-grain emulsion in the top layer of the invention is prepared in accordance with the following procedure:

In a 20 liter reactor, 3.7 liters of distilled water, 98.5 g of gelatin and 175 mg per mole of silver of a thioether solvent are introduced, and this solution is adjusted to a pAg equal to 8 by the addition of a solution of NaCl and to a pH of 5.5 at 38° C.

Nucleation is effected by double-jet precipitation from a solution of $AgNO_3$ (3.05 mol/l) and a solution of NaCl/NaBr in a ratio of 50:50 (3.293 mol/l) for a period of 35 seconds at a constant pAg.

Precipitation is then carried out by the double-jet method at a constant rate for 15 minutes with the same solutions, the temperature being maintained at 38° C. and the pAg at 8.5 moles of an AgBrCl (50:50) monodisperse emulsion is obtained. The emulsion is then washed by conventional flocculation methods. This fine-grain emulsion consists of cubo-octahedral grains with a mean equivalent spherical diameter of 0.11 μm.

100% chloride and 100% bromide emulsions were prepared by the same method, as well as a chlorobromide emulsion containing 30% bromide.

EXAMPLE 3

Each of the emulsions prepared in Example 2 is applied to the photographic product whose structure was described above in Example 1 with a coverage of 0.15 mg/dm$^2$.

The products obtained in this way are exposed to light from a tungsten lamp (2850° K.). They are then processed in an AUTOPAN™ automatic processing machine comprising conventional Ektachrome™ R-3 processing baths, except that increasing quantities of 1,2,4-triazol-3-thiol were added to the first developer.

A reference photographic product having the structure described above in Example 1 and not comprising any top layer is processed in the same way.

The standard Ektachrome™ R-3 processing comprises the following stages:

| | |
|---|---|
| Black and white development | 1 min 15 |
| Washing | 1 min 30 |
| Re-exposure Color development (38° C.) | 2 min 15 |
| Washing | 0 min 45 |
| Bleach-fixing | 2 min |
| Washing | 2 min 15 |

For each photographic product, the following sensitometric characteristics are measured:

1) the sensitivity obtained for a density of 0.8 calculated by means of the formula $ER_{0.8}=100\ (1-LogE_{0.8})$,
2) the shoulder density which is represented by the density at an exposure of less than 0.5 LogE at the exposure giving a density of 0.8, hereinafter referred to as 0.5 SD,
3) the toe density which is represented by the density at an exposure greater than 0.4 LogE at the exposure giving a density of 0.8, hereinafter referred to as 0.4 TD, and
4) the toe density which is represented by the density at an exposure greater than 0.8 LogE at the exposure giving a density of 0.8, hereinafter referred to as 0.8 TD.

All these measurements are made for each sensitometric curve characterising each layer, sensitive respectively to red, green and blue radiation.

For each layer, a graph is traced which represents the variations in each sensitometric characteristic defined above versus the quantity of 1,2,4-triazol-3-thiol in the first developer expressed in mg/l, taking as a reference the values of the sensitometric characteristics obtained when the first developer does not contain any 1,2,4-triazol-3-thiol.

Figure 1A:
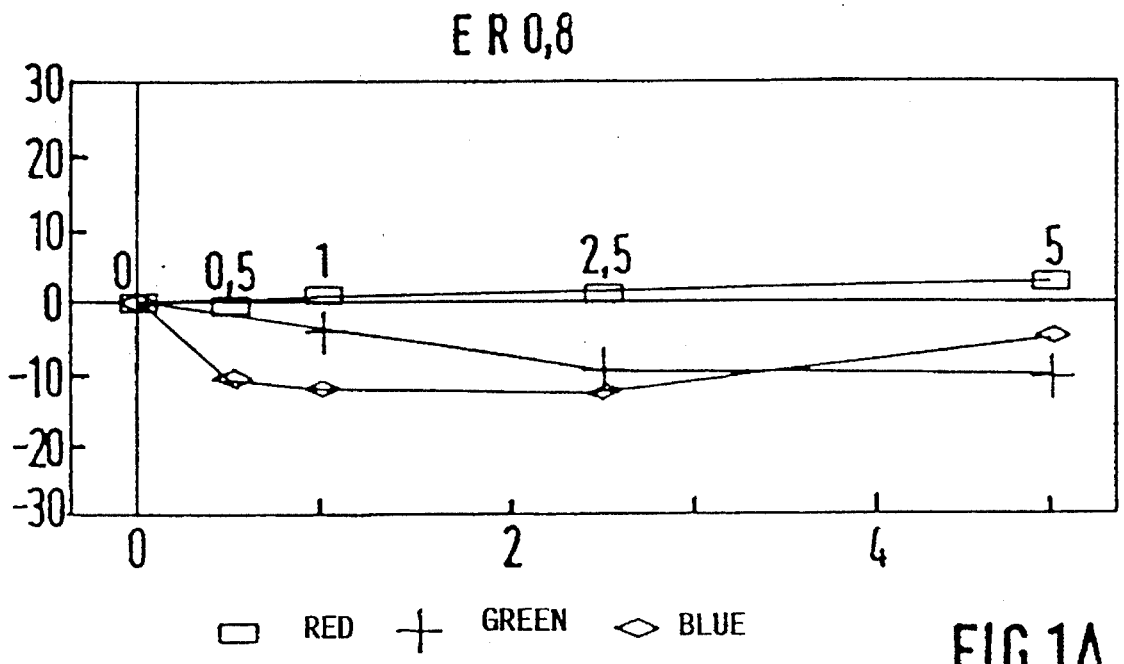
FIGS. 1A, 1B, 1C and 1D (reference) show the variations in the sensitometric characteristics defined above for each sensitive layer of the photographic product described previously which does not contain any top layer, versus the quantity of 1,2,4-triazol-3-thiol, which varies between 0 and 5 mg/l.
Figure 1B:
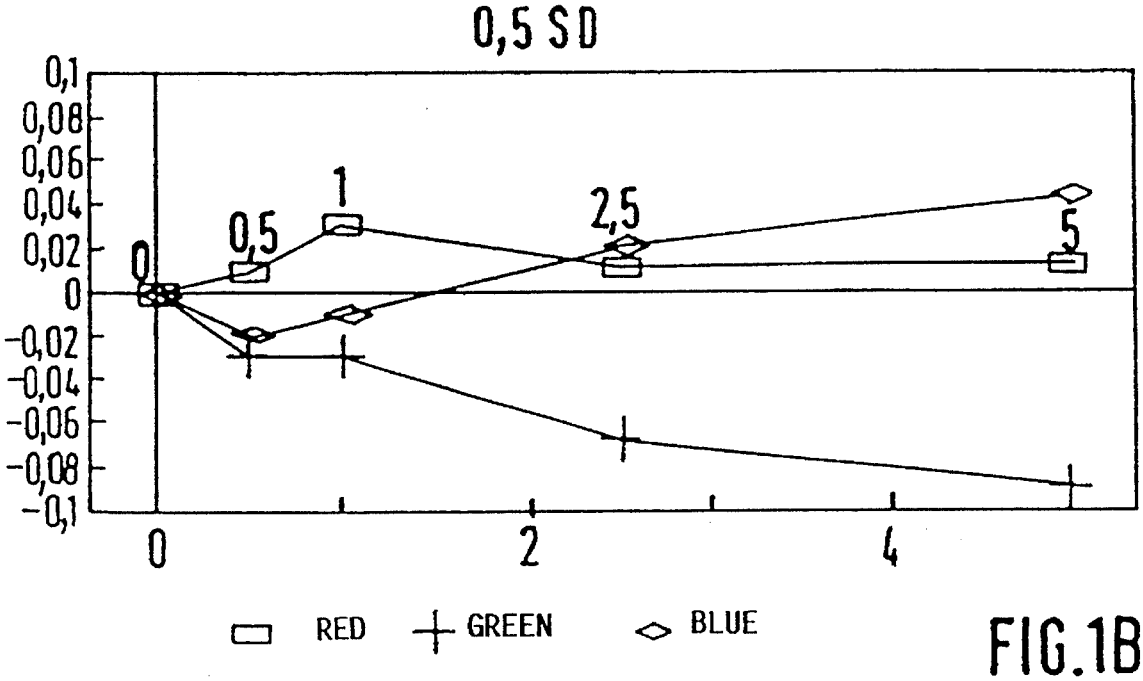
Figure 1C:
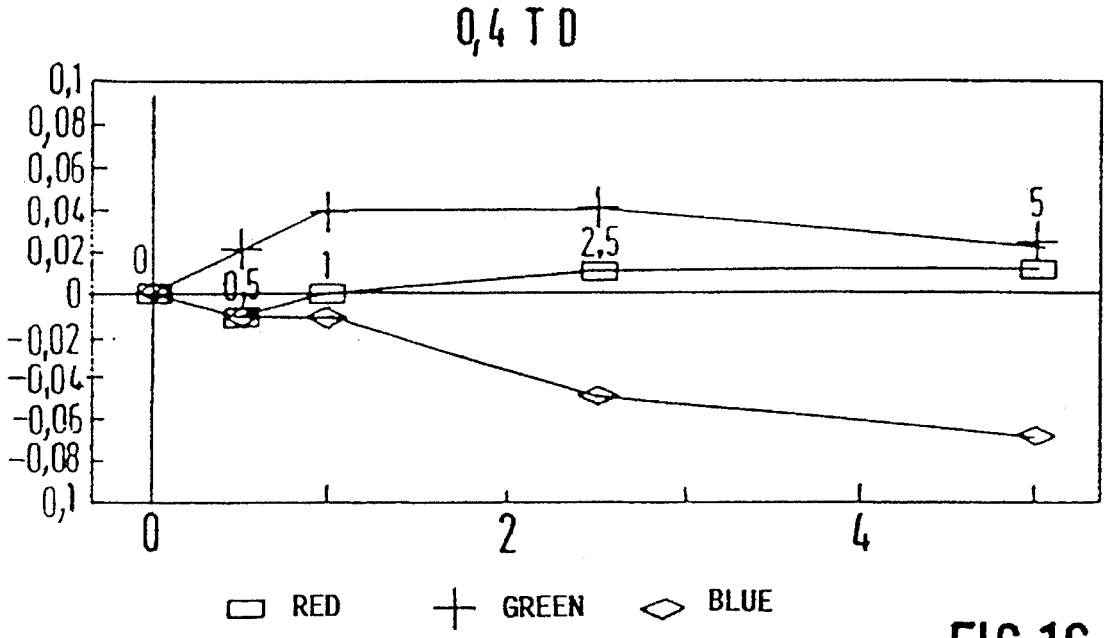
Figure 1D:
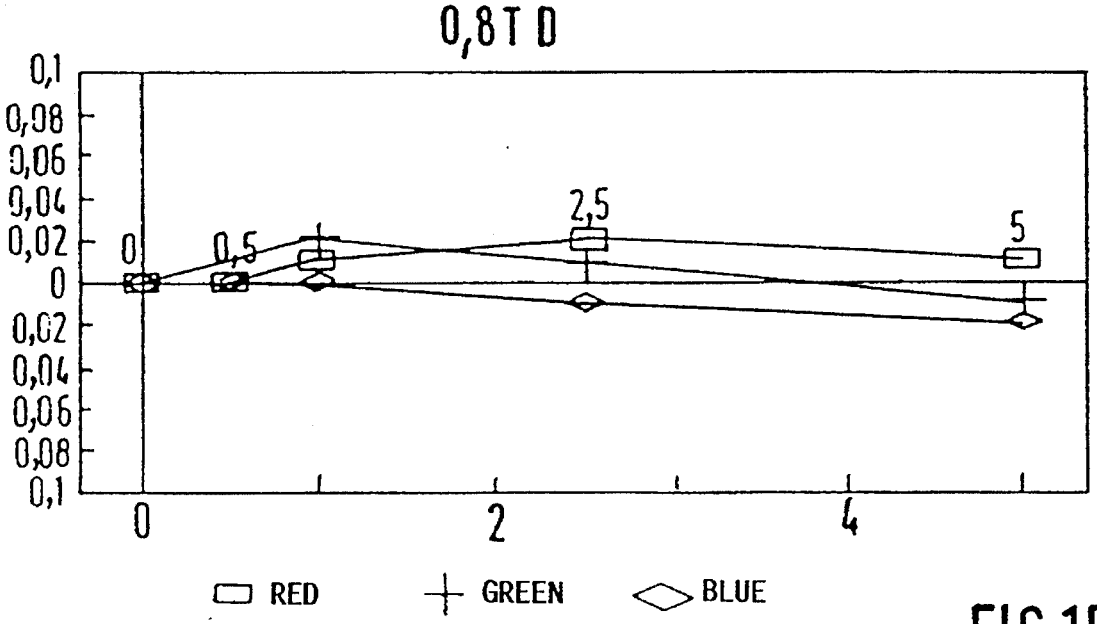
Figure 2A:
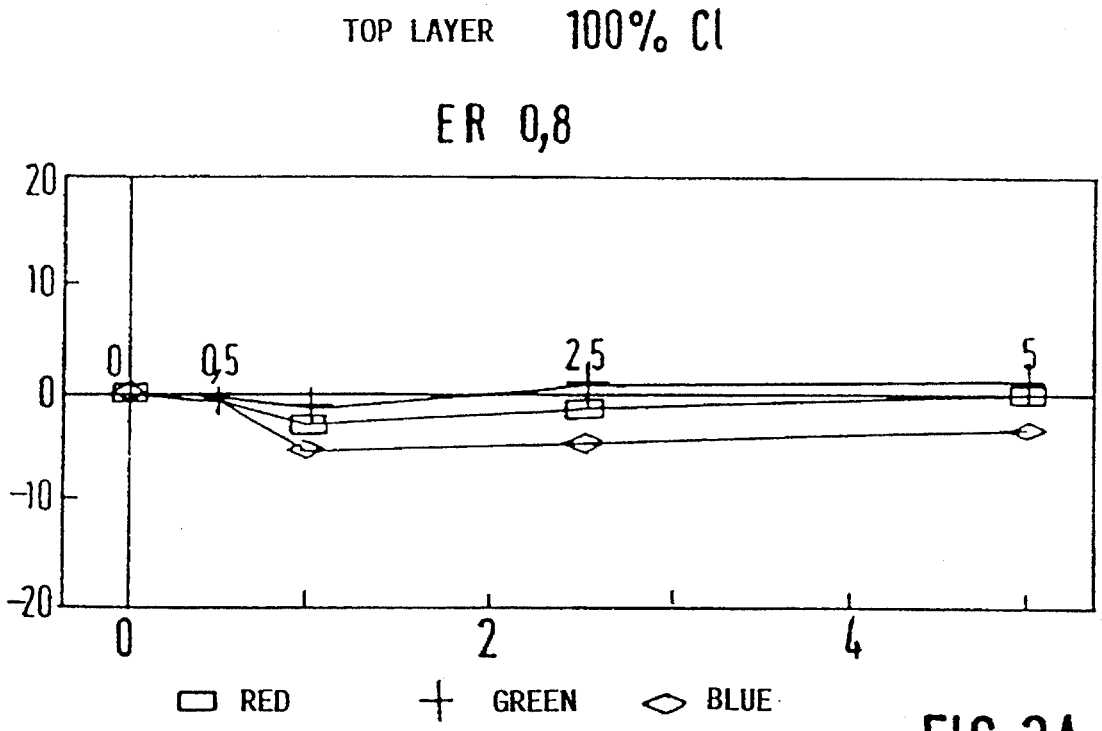
FIGS. 2A, 2B, 2C and 2D (comparison) show the variations in the sensitometric characteristics defined above of each sensitive layer of the photographic product described previously comprising a top layer of 100% chloride emulsion, versus the quantity of 1,2,4-triazol-3-thiol, which varies between 0 and 5 mg/l.
Figure 2B:
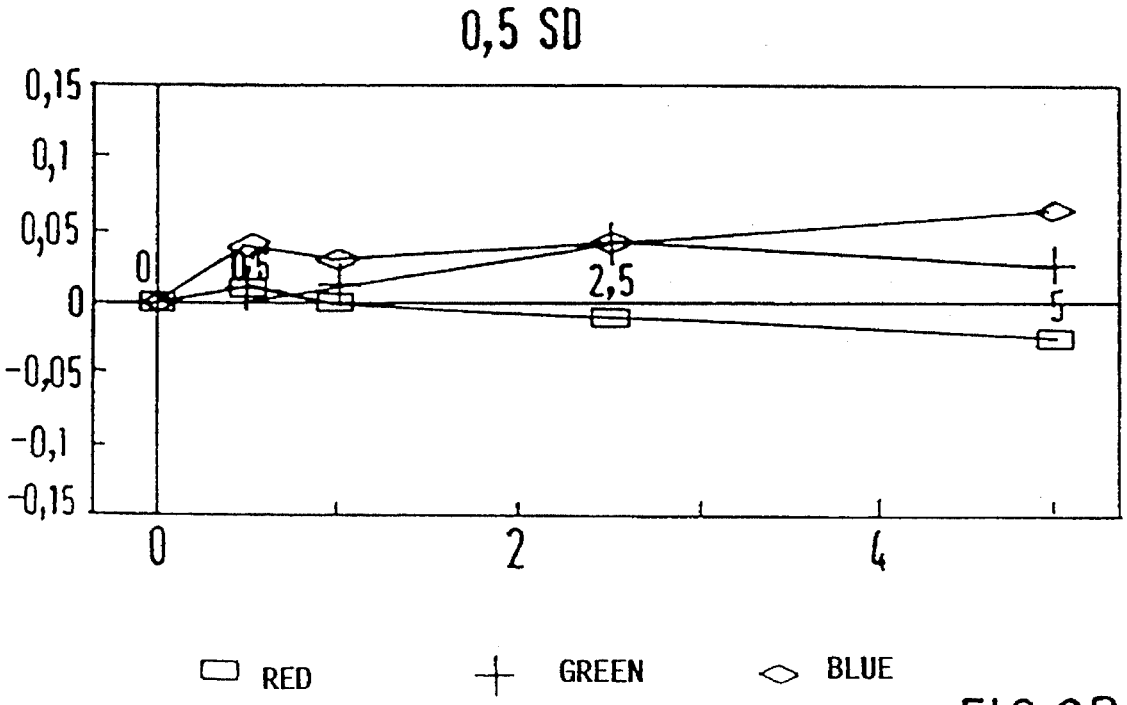
Figure 2C:
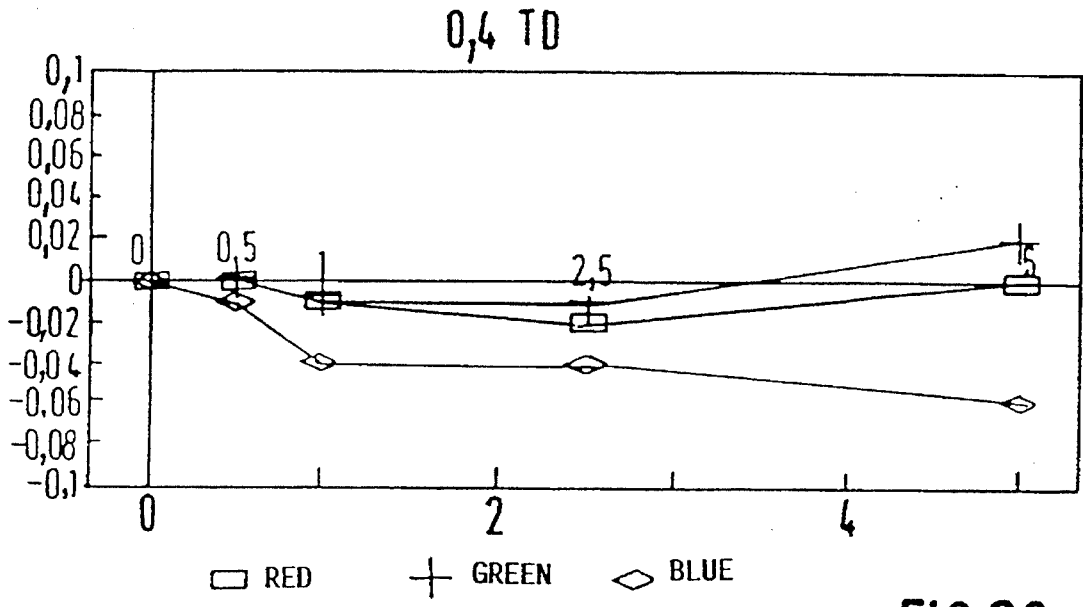
Figure 2D:
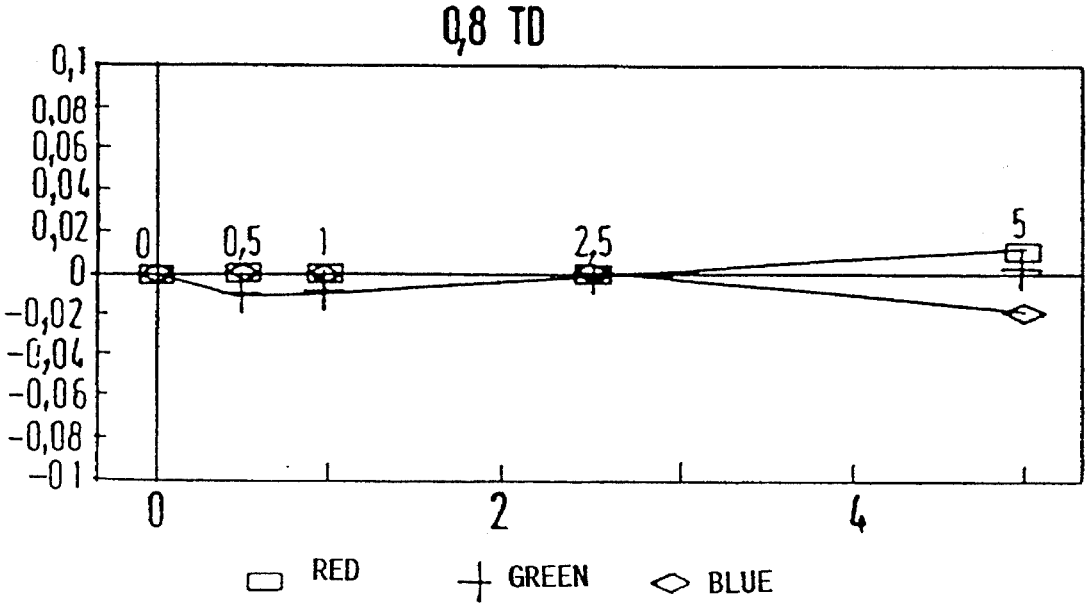
Figure 3A:
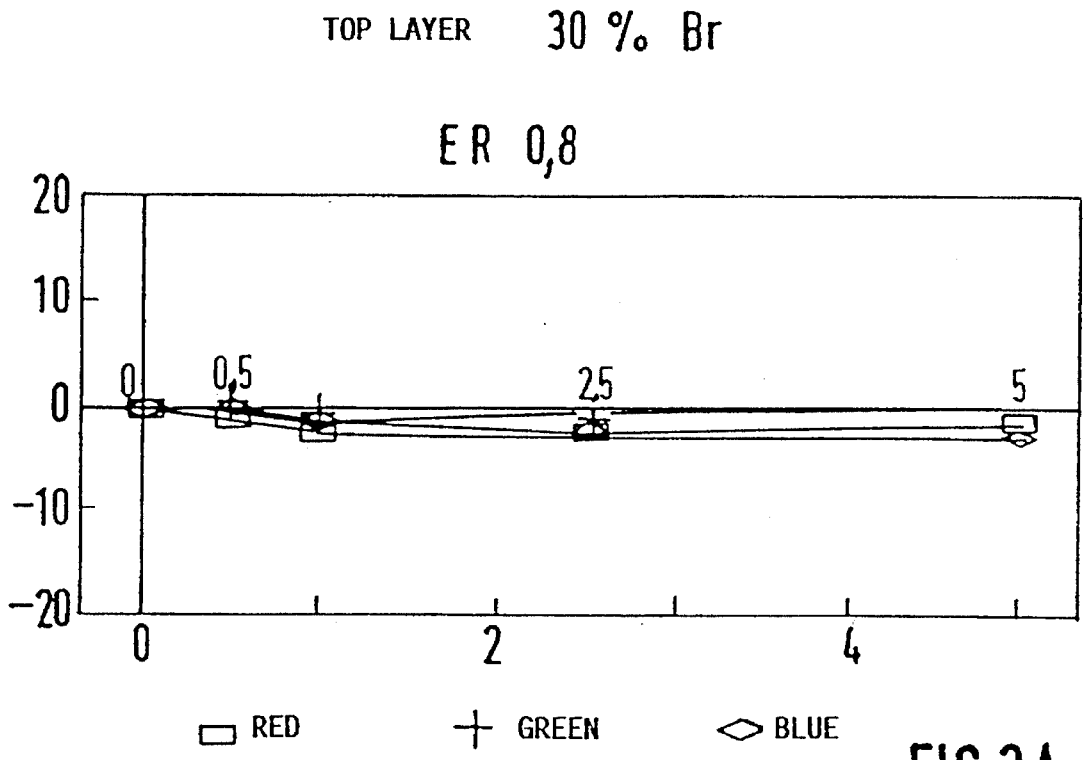
FIGS. 3A, 3B, 3C and 3D (invention) show the variations in the sensitometric characteristics defined above of each sensitive layer of the photographic product described previously comprising a top layer of 30% bromide emulsion versus the quantity of 1,2,4-triazol-3-thiol, which varies between 0 and 5 mg/l.
Figure 3B:
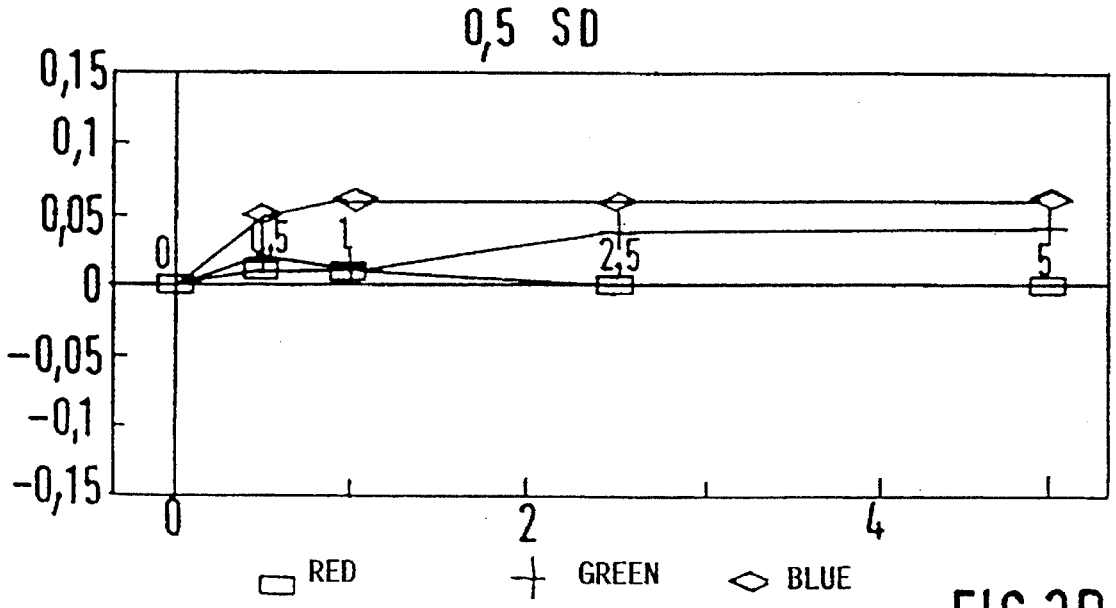
Figure 3C:
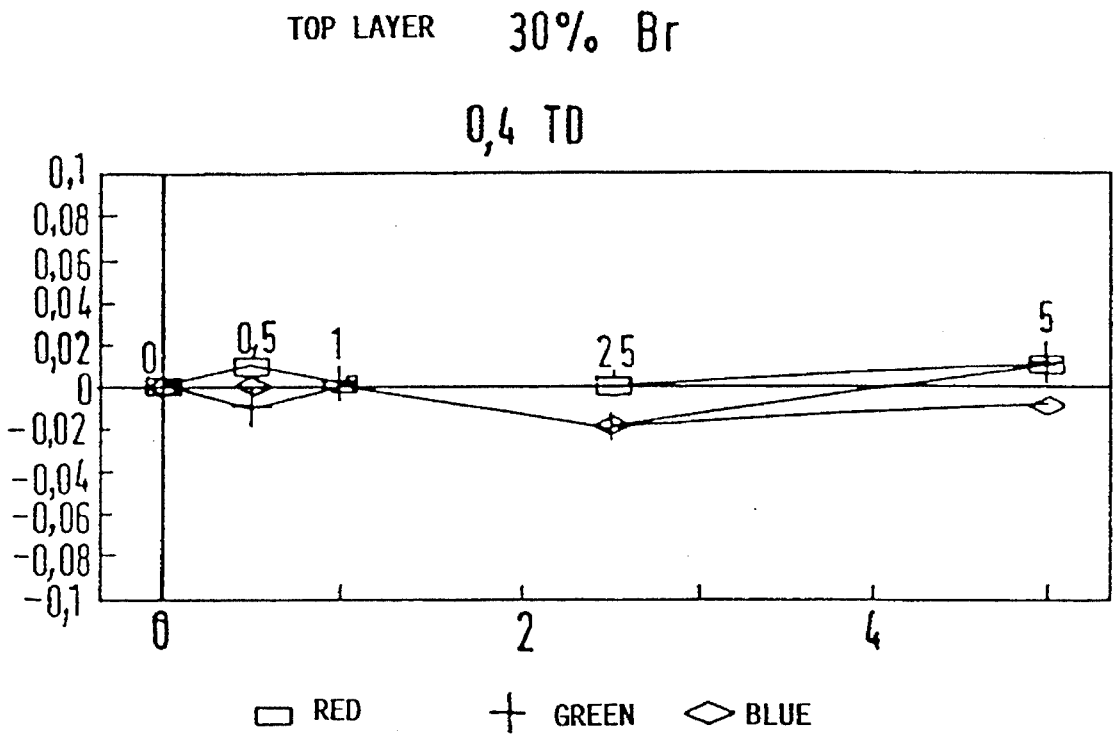
Figure 3D:
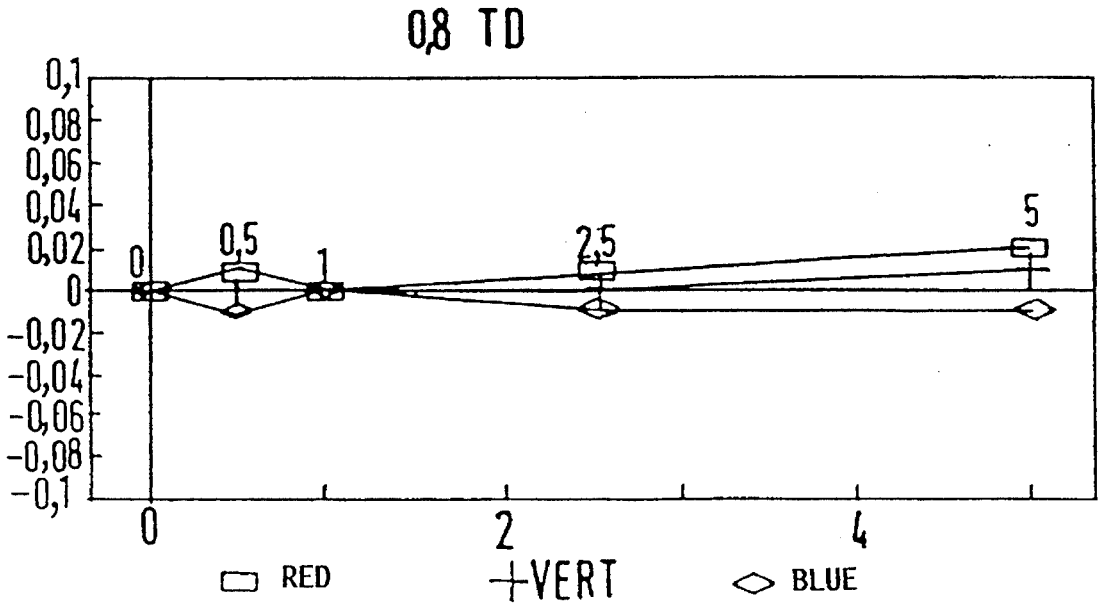
Figure 4A:
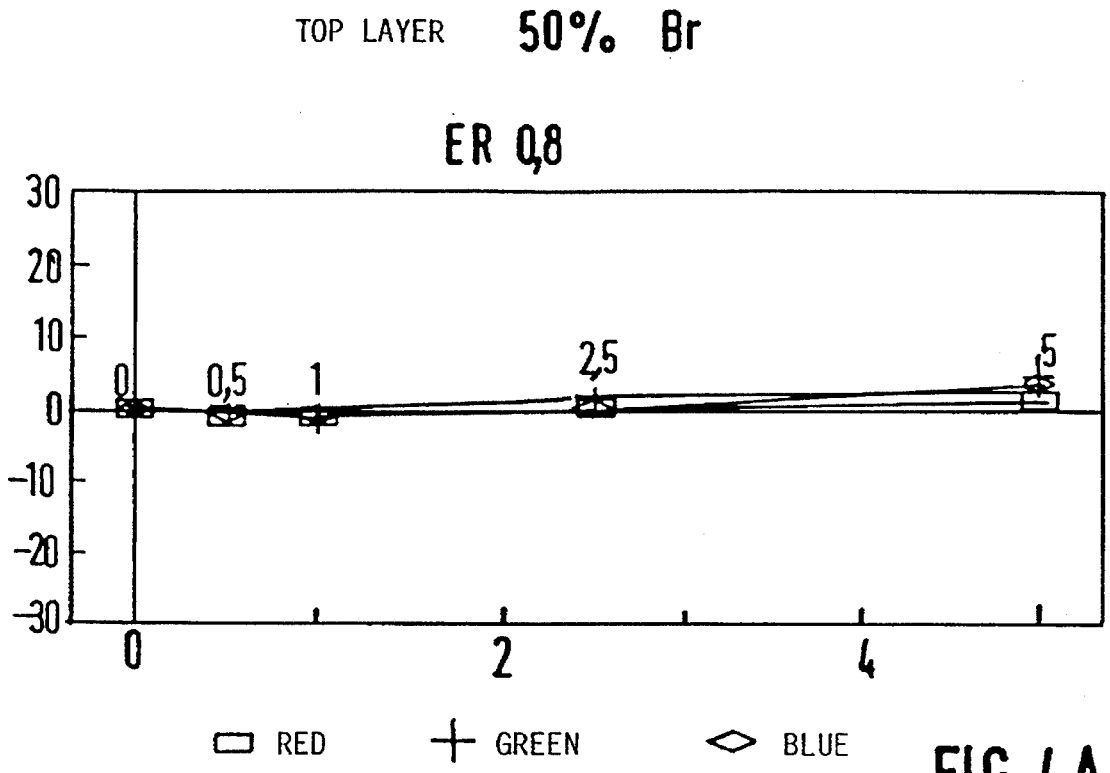
FIGS. 4A, 4B, 4C and 4D (invention) show the variations in the sensitometric characteristics defined above of each sensitive layer of the photographic product described previously comprising a top layer of 50% bromide emulsion, versus the quantity of 1,2,4-triazol-3-thiol, which varies between 0 and 5 mg/l.
Figure 4B:
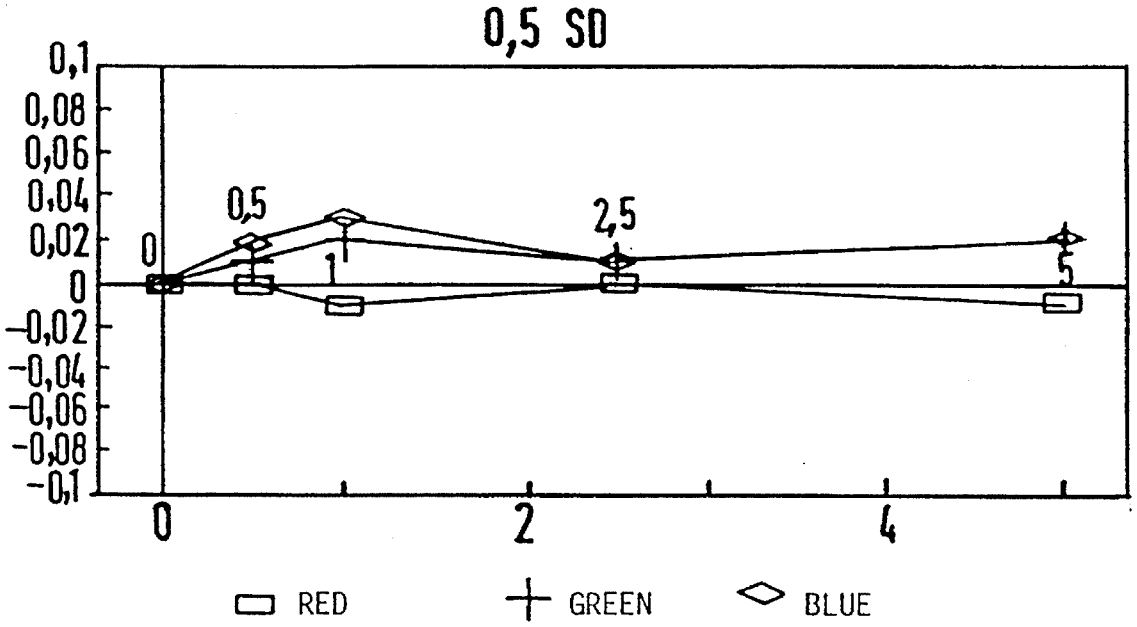
Figure 4C:
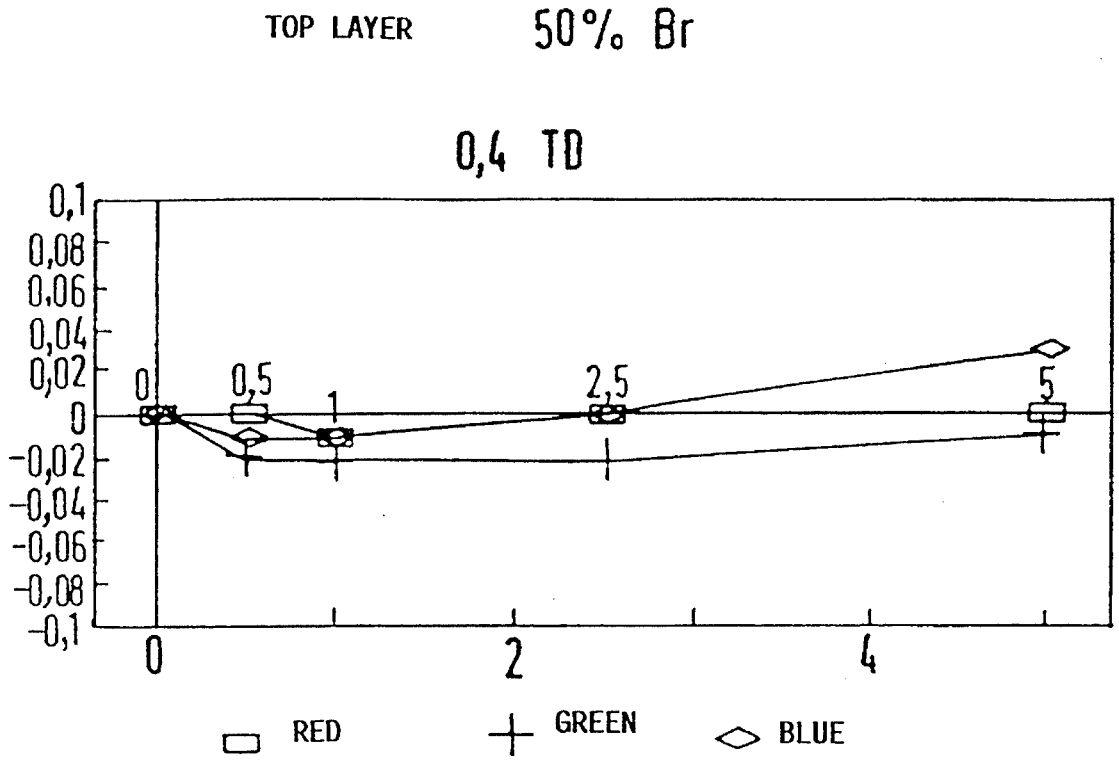
Figure 4D:
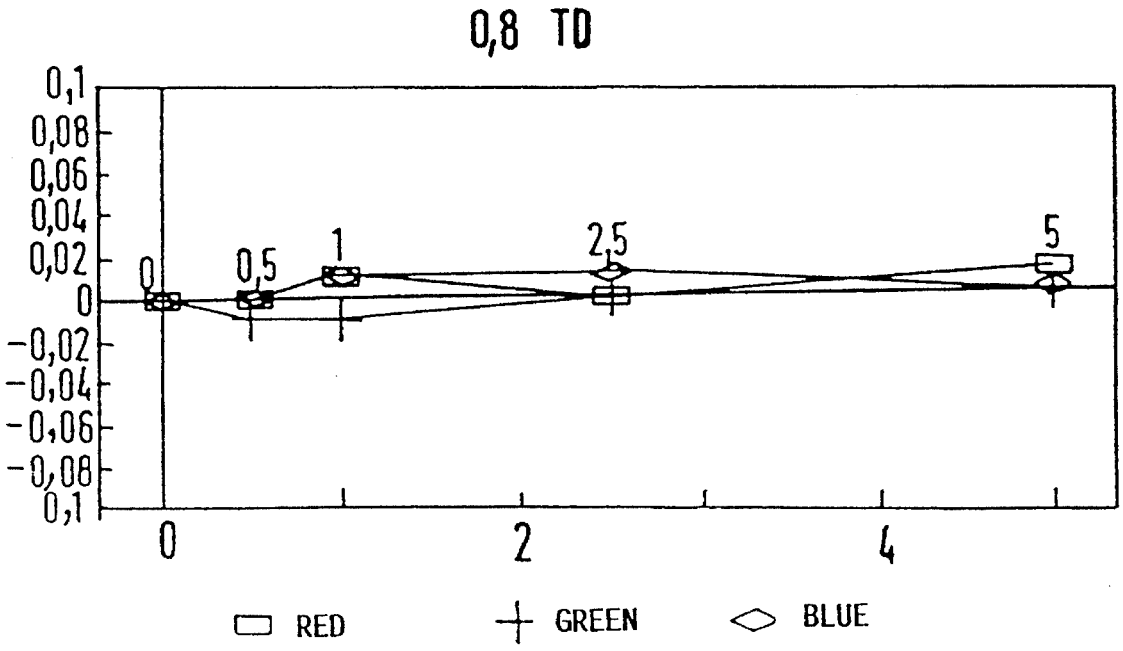
Figure 5A:
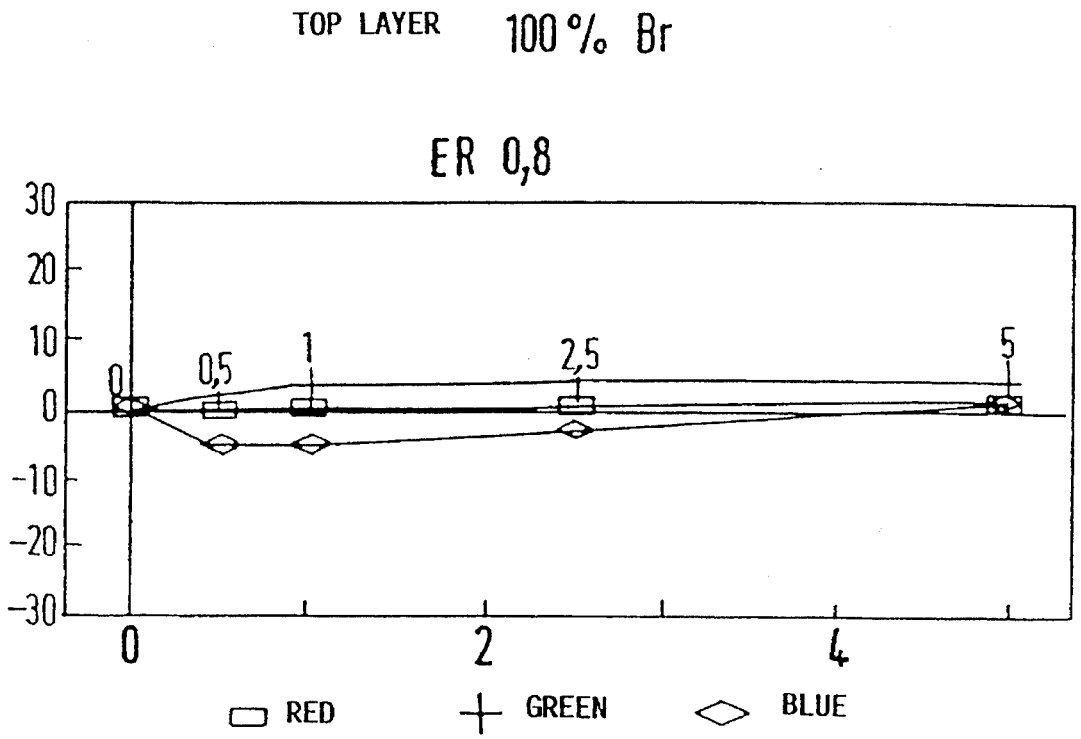
Figure 5B:
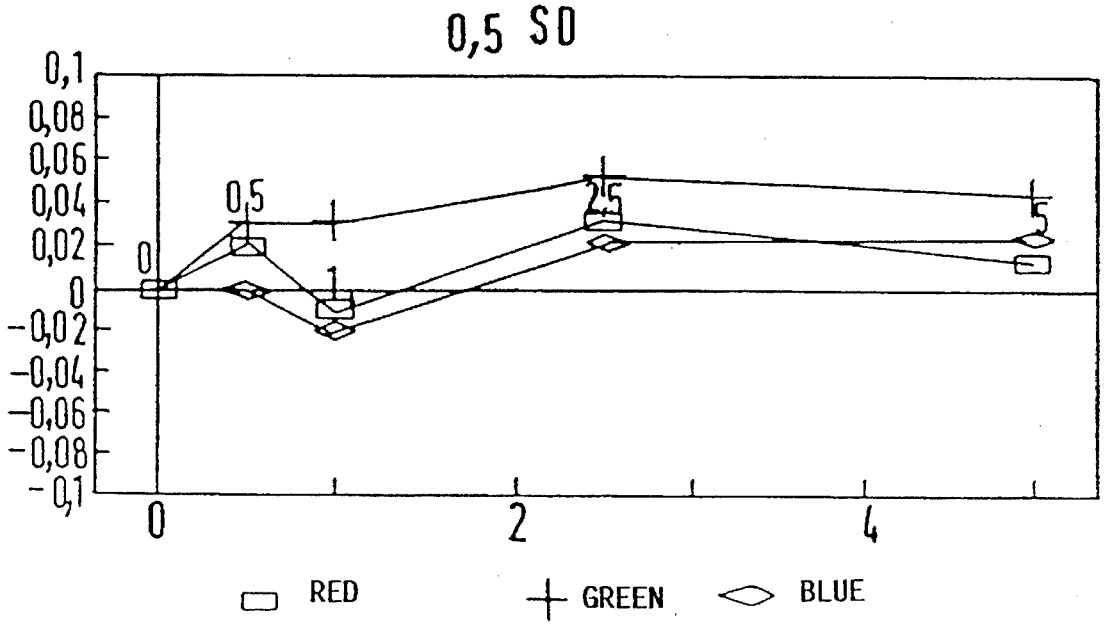
Figure 5C:
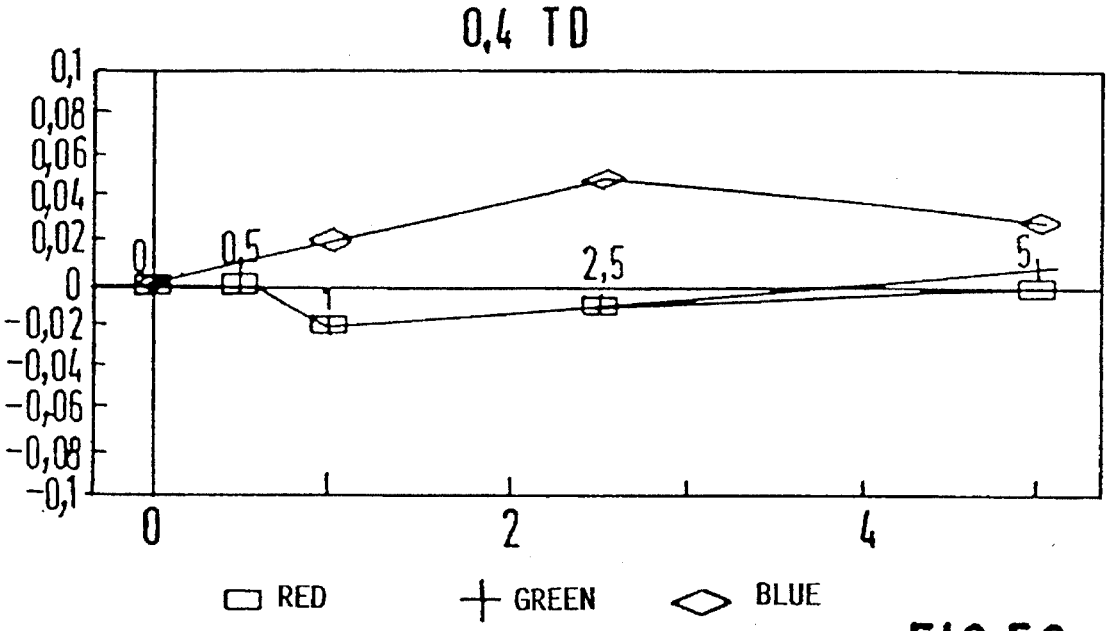
Figure 5D:
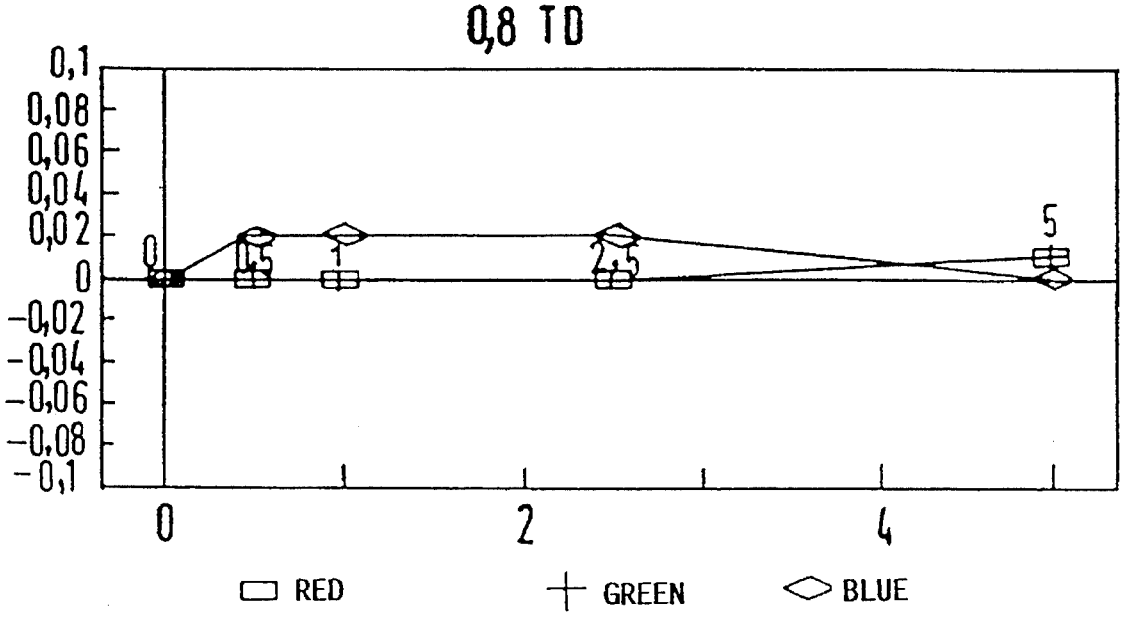

5A, 5B, 5C and 5D (comparison) show the variations in the sensitometric characteristics defined above of each sensitive layer of a photographic product described previously comprising a top layer of 100% bromide emulsion versus the quantity of 1,2,4-triazol-3-thiol, which varies between 0 and 5 mg/l.

Comparing the variations in the sensitometric characteristics observed, it can be noted that the addition of a top layer of the invention to a color photographic product makes it possible to control the sensitivity during processing in the presence of the contaminating compound.

In fact, it has been possible to show that the variations in the sensitometric characteristics of the photographic products of the invention remain small even when they are processed in a first developer having a concentration of contaminating compound as high as 5 mg/l.

Moreover, this top layer makes it possible to avoid any rapid deterioration in the effectiveness of the first developing bath.

We claim:

1. A method for controlling the sensitivity of a color photographic product during photographic processing, said color photographic product comprising a base, at least one light-sensitive silver halide emulsion layer and a top layer of non light-sensitive silver halide emulsion, wherein the exposed product is processed in a bleaching or in a bleach-fixing bath, characterised in that (A) the top layer of the photographic product consists of an emulsion comprising silver chlorobromide grains having a size of less than 0.5 μm and a bromide content of between 45 and 55% molar, and (B) said bleaching or bleach-fixing bath initially comprising a bleaching accelerator compound (1) defined by the formula:

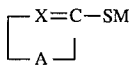

in which X represents a nitrogen, A represents the complementary atoms required to form an unsaturated ring which may contain one or more heteroatoms and M represents a hydrogen atom, an alkali metal or an ammonium group, provided that said unsaturated ring is an azole, diazole, triazole or tetrazole ring.

2. A method according to claim 1 wherein the bleaching accelerator compound is 1,2,4-triazole-3-thiol.

3. A method according to claim 1, wherein the silver halide grains in the top layer have a mean size of between 0.1 and 0.3 μm.

4. A method according to claim 1 wherein the bromide content is about 50% molar.

5. A method according to claim 3, wherein the coverage of the top layer is between 0.05 and 0.5 mg/dm$^2$.

6. A method according to claim 1, wherein the color photographic product comprises at least one photographic emulsion consisting of silver halide grains having a core/shell structure.

7. A method according to claim 1, wherein the color photographic product comprises at least one silver bromoiodide photographic emulsion.

8. A method according to claim 1, wherein the color photographic product comprises at least one monodisperse photographic emulsion.

9. A method according to claim 1, wherein at least one of the light-sensitive layers consists of a mixture of photographic emulsions with different sensitivities.

10. A method according to claims 1, for the processing of reversible color photographic products.

11. The method of claim 1 wherein said bleaching accelerator compound (1) is present in said bleaching or bleach-fixing fixing bath in an amount of up to 5 mg/l.

12. The method of claim 1 wherein said bleaching accelerator compound (1) is 1,2,4-triazole-3-thiol, 1,2,3-triazole-4-thiol, 1,2,3,4-tetrazole-5-thiol or glyoxaline-2-thiol.

13. A method for controlling the sensitivity of a color photographic product during photographic processing, said color photographic product comprising a base, at least one light-sensitive silver halide emulsion layer and a top layer of non light-sensitive silver halide emulsion, wherein the exposed product is processed in a bleaching or in a bleach-fixing bath, characterised in that (A) the top layer of the photographic product consists of an emulsion comprising silver chlorobromide grains having a size of less than 0.5 μm and a bromide content of between 45 and 55% molar, and (B) said bleaching or bleach-fixing bath initially comprising 1,2,4-triazole-3-thiol as a bleaching accelerator compound.

14. A method for controlling the sensitivity of a color photographic product during photographic processing, said color photographic product comprising a base, at least one light-sensitive silver halide emulsion layer and a top layer of non light-sensitive silver halide emulsion, wherein the exposed product is processed in a bleaching or in a bleach-fixing bath, characterised in that (A) the top layer of the photographic product consists of an emulsion comprising silver chlorobromide grains having a size of less than 0.5 μm and a bromide content of between 45 and 55% molar, and (B) said bleaching or bleach-fixing bath initially comprising 1,2,4-triazole-3-thiol, 1,2,3-triazole-4-thiol, 1,2,3,4-tetrazole-5-thiol or glyoxaline-2-thiol as a bleaching accelerator compound.

* * * * *